US008917892B2

(12) United States Patent
Poe et al.

(10) Patent No.: US 8,917,892 B2
(45) Date of Patent: Dec. 23, 2014

(54) AUTOMATED REAL SPEECH HEARING INSTRUMENT ADJUSTMENT SYSTEM

(76) Inventors: Michael L. Poe, Seminole, FL (US); Anthony Quick, Orlando, FL (US); Srinivas Chari, Winter Springs, FL (US); Don E. K. Campbell, Winter Springs, FL (US)

( * ) Notice: Subject to any disclaimer, the term of this patent is extended or adjusted under 35 U.S.C. 154(b) by 426 days.

(21) Appl. No.: 13/385,270

(22) Filed: Feb. 10, 2012

(65) Prior Publication Data

US 2012/0140937 A1 Jun. 7, 2012

Related U.S. Application Data

(63) Continuation-in-part of application No. 12/106,893, filed on Apr. 21, 2008, now abandoned.

(60) Provisional application No. 60/925,623, filed on Apr. 19, 2007.

(51) Int. Cl.
*H04R 25/00* (2006.01)

(52) U.S. Cl.
USPC ..... 381/318; 381/312

(58) Field of Classification Search
CPC .... H04R 25/70; H04R 25/356; H04R 25/407; H04R 25/453; H04R 25/502; H04R 25/505; H04R 25/554; H04R 2225/41; H04R 2225/43; H04R 2430/03; H03H 21/0012
USPC ..... 381/23.1, 60, 71.1, 71.6, 94.1, 312, 381/317, 318
See application file for complete search history.

(56) References Cited

U.S. PATENT DOCUMENTS

| | | | | |
|---|---|---|---|---|
| 4,548,082 | A * | 10/1985 | Engebretson et al. | 381/328 |
| 5,825,894 | A * | 10/1998 | Shennib | 381/60 |
| 5,923,764 | A | 7/1999 | Shennib | |
| 5,991,417 | A | 11/1999 | Topholm | |
| 2007/0003077 | A1 | 1/2007 | Pedersen | |

* cited by examiner

*Primary Examiner* — Brian Ensey
(74) *Attorney, Agent, or Firm* — Ice Miller LLP

(57) ABSTRACT

A method for adjusting a hearing instrument to reduce feedback by placing a hearing instrument having an adjustable frequency response in a wearer's ear, providing a probe microphone for measuring the sound pressure level inside the ear and a reference microphone for measuring the sound pressure level outside the ear, exposing the ear to a stimulus and a dynamic event, determining the gain as a function of frequency from the difference in sound pressure level measured by the probe microphone and the reference microphone, identifying a feedback peak where the frequency is in the center of a range of frequencies and corresponds to the maximum gain in that range of frequencies and adjusting the hearing instrument to reduce the gain at a frequency corresponding to the frequency of the feedback peak.

22 Claims, 13 Drawing Sheets

AUTOMATED REAL SPEECH HEARING INSTRUMENT ADJUSTMENT SYSTEM

This is a continuation-in-part application of application Ser. No. 12/106,893, filed Apr. 21, 2008, which claims the benefit of U.S. Provisional Application No. 60/925,623, filed Apr. 19, 2007, both of which are hereby incorporated by reference in their entirety.

BACKGROUND

This disclosure relates to systems and methods of fitting hearing devices and more particularly to systems and methods of fitting hearing devices wherein measurements of the output of the hearing device are taken within the ear of the intended wearer of the hearing device.

In regards to the human auditory system, hearing aid devices ("hearing instruments") are often used to compensate for hearing loss. The primary function of hearing instruments is to amplify the incoming signal in a manner appropriate to make the signal audible to the user. The amount of signal amplification may differ at various frequencies, normally audible to the human ear, based upon the degree of hearing loss at each frequency. Another important function of a hearing instrument is to limit the amplification of the incoming sound to a level that is not intolerable or uncomfortable to the user of the instrument.

Improving the audibility of human speech is the most important function of a hearing instrument. The hearing instrument's parameters affecting the amount of amplification and the limits of amplification are often adjusted to emphasize the speech signals that contribute most to the comprehension of human speech. Various frequency bands that are known to contain more useful speech information are emphasized or amplified more than other frequency bands containing less speech information.

A majority of hearing instruments currently fit to the human ear are both digital and programmable. These instruments have a multitude of parameters that are adjustable. These parameters are adjusted utilizing a computer or other hardware device, software dedicated to a particular manufacturer's hearing aid device, hardware that allows communication between the computer and the hearing aid device (such as HIPRO or NOAH LINK made by G. N. Otometrics), and a cable that connects the hardware to the hearing instrument. Adjusting these parameters to best benefit the user may be done by the dispenser of the device. The dispenser uses manufacturer provided guidelines, "first fit" or "best fit" protocols, fitting help guides, and in ear measurements, as well as their professional judgment, and subjective comments from the user, or any combination of the these tools to adjust the hearing instrument in an attempt to improve the audibility and comfort of speech signals as determined by the hearing loss of the user.

Hearing instruments have been designed based on the "average ear," and do not take into account the structural differences among individual ears. Therefore, if a hearing instrument is used on an ear that differs structurally from the average ear, the hearing instrument could produce an insertion response that is substantially different from what one would expect based on average ear data. In addition, the measured insertion response may not match the target response. The many factors that contribute to actual response curves differing from prescriptive target curves include pinna effects, microphone placement, unusual external ears (concha, shape and size), and/or eardrums, abnormal middle-ear compliance (normal, flaccid, stiff), ear canal volume (length/diameter/shape), hearing instrument shell/earmold material (hard, soft), insertion depth, vent diameter and length, and resonant frequency of the user's ear canals.

Prescriptive procedures to determine the proper amount of gain, or sound pressure level ("SPL") for hearing aids have been used as far back as 1960. The amount of gain adjustments suggested by the manufacturer's software to optimize the audibility and comfort of the incoming signal for the user of the hearing instrument is based on "average ear" canal and pinna resonance values. Analyzing tools have been developed to provide the dispenser with better information about the amount of frequency-specific amplification a hearing aid is providing to a specific user. These analyzing tools utilize a probe tube that is inserted into a hearing instrument user's ear canal between the hearing instrument and the patient's ear drum to measure the amount of hearing instrument output in an effort to provide the dispenser some degree of "real" ear instead of "average" ear information. Some of these analyzing tools produce simple or complex tones at various frequencies as input to the hearing aid device, which is then measured as output in the ear canal.

More recently, analyzing tools have been developed that utilize recorded or live speech as the input signal, such as the MedRx Avant™ REM Speech System. These devices provide the dispenser a better understanding of the audibility and comfort of important amplified speech signals.

The dispenser of a hearing instrument currently can use information derived from speech mapping analyzing tools and the various programmable parameters of the hearing aid device to manually adjust the device. These manual adjustments are undertaken in an attempt to provide the user of the device with improved speech audibility and comfort. These manual adjustments require professional knowledge and an understanding of the correct manual manipulations required in each hearing aid manufacturer's software. Because the adjustments are made manually, they are time consuming and therefore can contribute to the cost of a hearing aid device and possibly decrease the amount of time the dispenser has available to counsel the hearing instrument user about the care and use of the instrument. If the dispenser lacks sufficient experience, the adjustments may not be completed properly. As a result, the hearing instrument user might not receive the full benefit from the use of the device and/or may refuse to wear the instrument.

Thus, hearing instrument manufacturers, sellers and users would appreciate a system and method that facilitate automatically fitting hearing instruments to a user that senses the in ear response of the hearing instrument to speech stimuli and adjusts controllable parameters of hearing instrument.

SUMMARY OF THE INVENTION

According to one aspect of the disclosure, a method for automatically fitting a hearing instrument while the hearing instrument is worn by a user listening to a speech signal includes receiving an audiogram of the user, determining a target gain for the hearing instrument as a function of the audiogram, placing the hearing instrument in situ, exposing a first microphone located outside an ear of the user to the speech signal and a second microphone coupled to the inside of the ear to the output of the hearing instrument, measuring a first sound pressure level (SPL) outside the ear via the first microphone, measuring a second SPL inside the ear of the user via the second microphone, determining an offset gain as a function of the first SPL, the target gain and the second SPL, and adjusting a gain of the hearing instrument according to the offset gain.

According to another aspect of the disclosure, a method for fitting a hearing instrument comprises placing the hearing instrument in situ includes receiving an audiogram of the user, determining a target gain for the hearing instrument as a function of the audiogram, exposing a reference sensor located adjacent the hearing instrument to an external speech signal, measuring an external sound pressure level (SPL) via the reference sensor, exposing a probe sensor coupled to the inside of the ear to the output of the hearing instrument while the hearing instrument is in situ, measuring an internal sound pressure level ("SPL") inside the ear of the user via the probe sensor, determining an offset gain as a function of the external SPL, the target gain and the internal SPL, and automatically adjusting a gain of the hearing instrument according to the offset gain.

According to another aspect of the disclosure, a system for automatically fitting a hearing impaired person with a digital hearing aid in situ includes a digital hearing aid, a reference volume sensor, a probe sensor, a sound mapping module and a parameter control module. The digital hearing aid includes a digital signal processor and an interface for receiving instructions to the digital signal processor to modify parameters applied during the digital signal processing which affect the output of the hearing aid. The reference volume sensor is configured for positioning adjacent the hearing aid to receive external sounds from a speech stimulus and to output a signal indicative of the volume of the speech stimulus over a range of frequencies. The probe sensor is configured to output a signal indicative of the in ear volume level produced by the speech stimulus over a range of frequencies. The sound mapping module runs on a processor communicating with the reference volume sensor and the probe sensor and configured to receive the signals indicative of volume over a range of frequencies therefrom and store values generated from the signal indicative of the sensed volume at various frequencies within the ranges of frequencies. The parameter control module runs on a processor communicating with the sound mapping module for receiving the stored values generated from the signal indicative of the sensed volume at various frequencies within the ranges of frequencies and coupled to the interface of the hearing instrument for providing instructions to the digital signal processor to modify parameters applied during the digital signal processing.

According to another aspect of the disclosure, a method for adjusting a hearing instrument to reduce feedback comprises placing a hearing instrument having an adjustable frequency response in a wearer's ear, providing a probe microphone for measuring the sound pressure level inside the ear, and a reference microphone for measuring the sound pressure level outside the ear, and exposing the ear to a stimulus and a dynamic event. The dynamic event can be a physical event. The gain as a function of frequency is determined from the difference in sound pressure level measured by the probe microphone and the reference microphone. A feedback peak is identified where the frequency is in the center of a range of frequencies and corresponds to the maximum gain in that range of frequencies. The hearing instrument is adjusted to reduce the gain at a frequency corresponding to the frequency of the feedback peak.

The method for adjusting a hearing instrument to reduce feedback can further comprise the step of providing a predetermined feedback threshold gain, wherein a feedback peak is identified where the frequency is in the center of a range of frequencies and corresponds to the maximum gain in that range of frequencies, and the gain is greater than the feedback threshold gain. The feedback threshold gain can be 17 dB. The gain as a function of frequency can be determined in segments of frequency bands, and a feedback peak is identified where the frequency band in a window of frequency bands has the maximum gain of the frequency bands in that window. The window of bands can have an odd number of frequency bands. In a particularly preferred embodiment, the window of frequency bands has 5 frequency bands.

According to another aspect of the disclosure, a method for adjusting a hearing instrument to reduce feedback comprises placing a hearing instrument having an adjustable frequency response in a wearer's ear, providing a probe microphone for measuring the sound pressure level inside the ear, and a reference microphone for measuring the sound pressure level outside the ear, exposing the ear to a stimulus and a dynamic event, determining a gain as a function of frequency from the difference in sound pressure level measured by the probe microphone and the reference microphone, identifying a potential feedback peak where the frequency is in the center of a range of frequencies and corresponds to the maximum gain in that range of frequencies, allowing a period of time to elapse and identifying an active feedback peak where the potential feedback peak persists after the period of time has elapsed, and adjusting the hearing instrument to reduce the gain at a frequency corresponding to the frequency of the active feedback peak. The dynamic event can be a physical event. The period of time can be in a range of between about 170 to about 1000 milliseconds. The gain as a function of frequency can be determined in segments of frequency bands and a feedback peak can be identified where the frequency band in a window of frequency bands has the maximum gain of the frequency bands in that window. The window of frequency bands can have an odd number of frequency bands. The window of frequency bands can have 5 bands.

The above described method can further comprise the step of providing a predetermined feedback threshold gain, wherein a potential feedback peak is identified where the frequency is in the center of a range of frequencies and corresponds to the maximum gain in that range of frequencies, and the gain is greater than the feedback threshold gain. The feedback threshold gain can be 17 dB.

According to another aspect of the disclosure, a method for adjusting a hearing instrument to reduce feedback comprises placing a hearing instrument having an adjustable frequency response in a wearer's ear, providing a probe microphone for measuring the sound pressure level inside the ear, and a reference microphone for measuring the sound pressure level outside the ear, and exposing the ear to a first stimulus. A gain is determined as a function of frequency from the difference in sound pressure level measured by the probe microphone and the reference microphone in response to the first stimulus. A first feedback peak is identified in response to the first stimulus where the frequency is in the center of a range of frequencies and corresponds to the maximum gain in that range of frequencies. The hearing instrument is adjusted to reduce the gain at a frequency corresponding to the frequency of the first feedback peak. The ear is exposed to a second stimulus and a dynamic event. The gain is determined as a function of frequency from the difference in sound pressure level measured by the probe microphone and the reference microphone in response to the second stimulus and dynamic event. A second feedback peak is identified in response to the second stimulus and dynamic event where the frequency is in the center of a range of frequencies and corresponds to the maximum gain in that range of frequencies. The hearing instrument is adjusted to reduce the gain at a frequency corresponding to the frequency of the second feedback peak. The dynamic event can be a physical event.

The gain as a function of frequency can be determined in segments of frequency bands, and a feedback peak is identified where the frequency band in a window of frequency bands has the maximum gain of the frequency bands in that window. The window of frequency bands can have an odd number of frequency bands. The window of frequency bands can have 5 frequency bands.

The above described method can further comprise the step of providing a predetermined feedback threshold gain, wherein a potential feedback peak is identified where the frequency is in the center of a range of frequencies and corresponds to the maximum gain in that range of frequencies and the gain is greater than the feedback threshold gain. The feedback threshold gain can be 17 dB.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The invention can be better understood with reference to the following drawings and description. The components in the figures are not necessarily to scale, emphasis instead being placed upon illustrating the principles of the invention. In the drawings.

DETAILED DESCRIPTION

A system and method that automatically adjust the parameters of a digital, programmable hearing instrument utilizing information derived from the results of speech mapping are presented. As used herein "speech" (unless specifically indicated otherwise) refers to live speech, pre-recorded speech signals, speech and noise signals, music signals and/or speech-like stimuli, calibrated stimuli, pure tones, random speech noise or other complex audio signals.

In one embodiment of the disclosed system and method, the dispenser or fitter of the hearing instrument obtains information through the use of a speech mapping system. The information obtained from the use of the speech mapping system is specific to the performance of the hearing instrument, the resonance of the user's external auditory canal and pinna, and the instrument user's hearing loss. Embodiments of the disclosed system and method utilize the hearing instrument manufacturer's fitting software and the information obtained from the use of the speech mapping system to automatically adjust the instrument's various controllable parameters. These adjustments are based on protocols developed by the manufacturer to best manipulate the various adjustable parameters of their own product so that incoming speech sounds are audible and tolerable to the actual user of the instrument.

One embodiment of the disclosed system and method automatically adjusts gain and/or phase cancellation to reduce feedback and/or the occlusion effect. Other embodiments of the disclosed system and method may adjust any adjustable parameter of the hearing instrument, such as the entrainment level, to increase the added stable gain of the hearing device and or the dynamic range of the patient. According to one embodiment of the disclosed system and method, the above described adjustments may all be made without requiring a product specific expertise of the dispenser.

Figure 1:
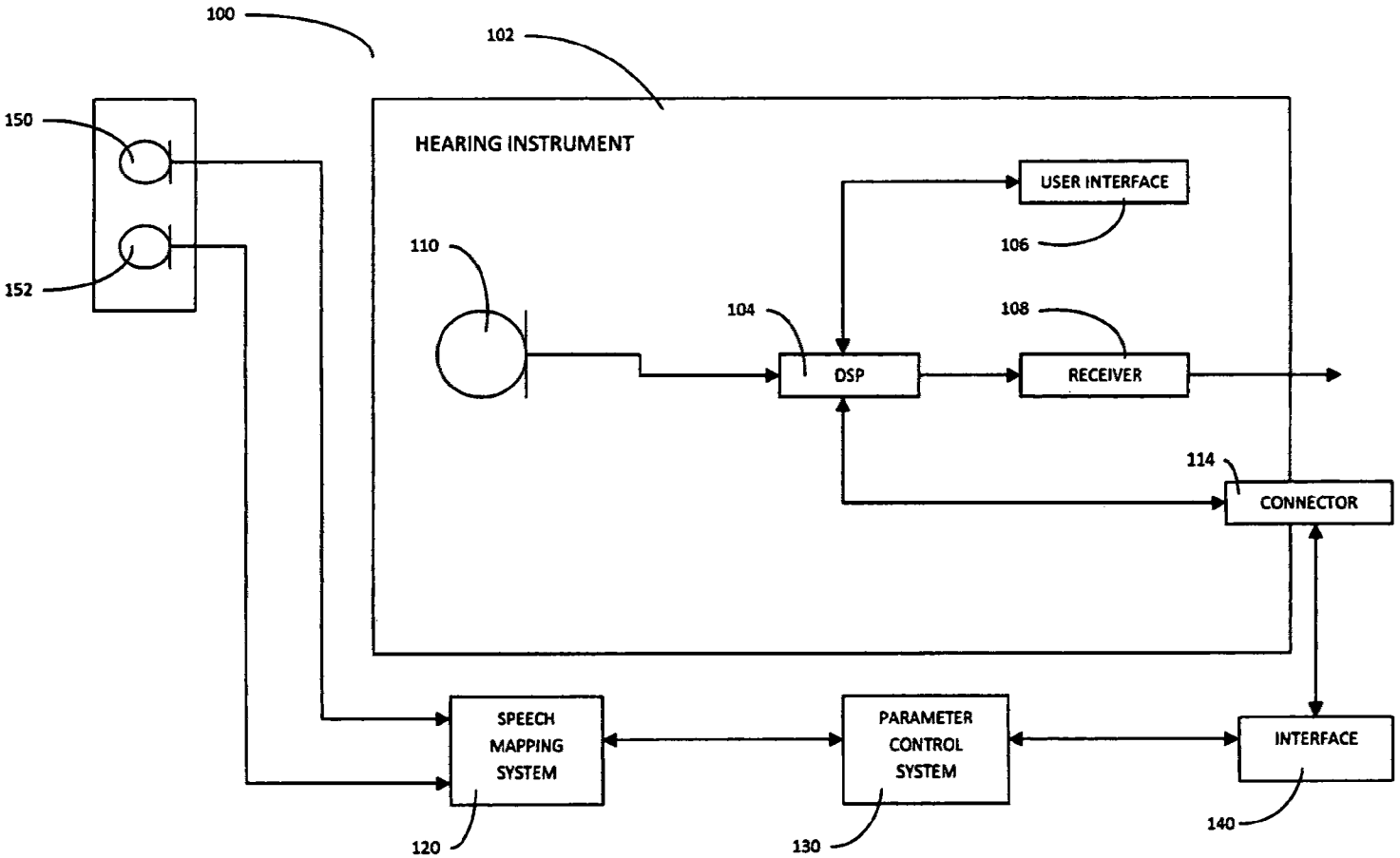
FIG. 1 is a functional block diagram of a real ear, real speech hearing instrument adjustment system.

As shown in FIG. 1, one embodiment of the disclosed system 100 includes a hearing instrument 102, a speech mapping system 120, a parameter control system 130, an interface 140, a probe microphone 150 and a reference microphone 152. The speech mapping system 120 is coupled with the parameter control system 130 and the probe and reference microphones 150, 152, respectively. The parameter control system 130 is coupled with the hearing instrument 102 via an interface 140. The interface 140 is coupled to a connector 114 on the hearing instrument 102. The hearing instrument 102, speech mapping system 120, parameter control system 130, interface 140 and probe and reference microphones 150, 152, respectively may communicate among each other using any type of electromagnetic communications via an electromagnetic channel or network, including microwave, RF, FM, optical, Bluetooth, whether wired or wireless, USB cable, CS 44 cable or other well-known means.

Figure 2:
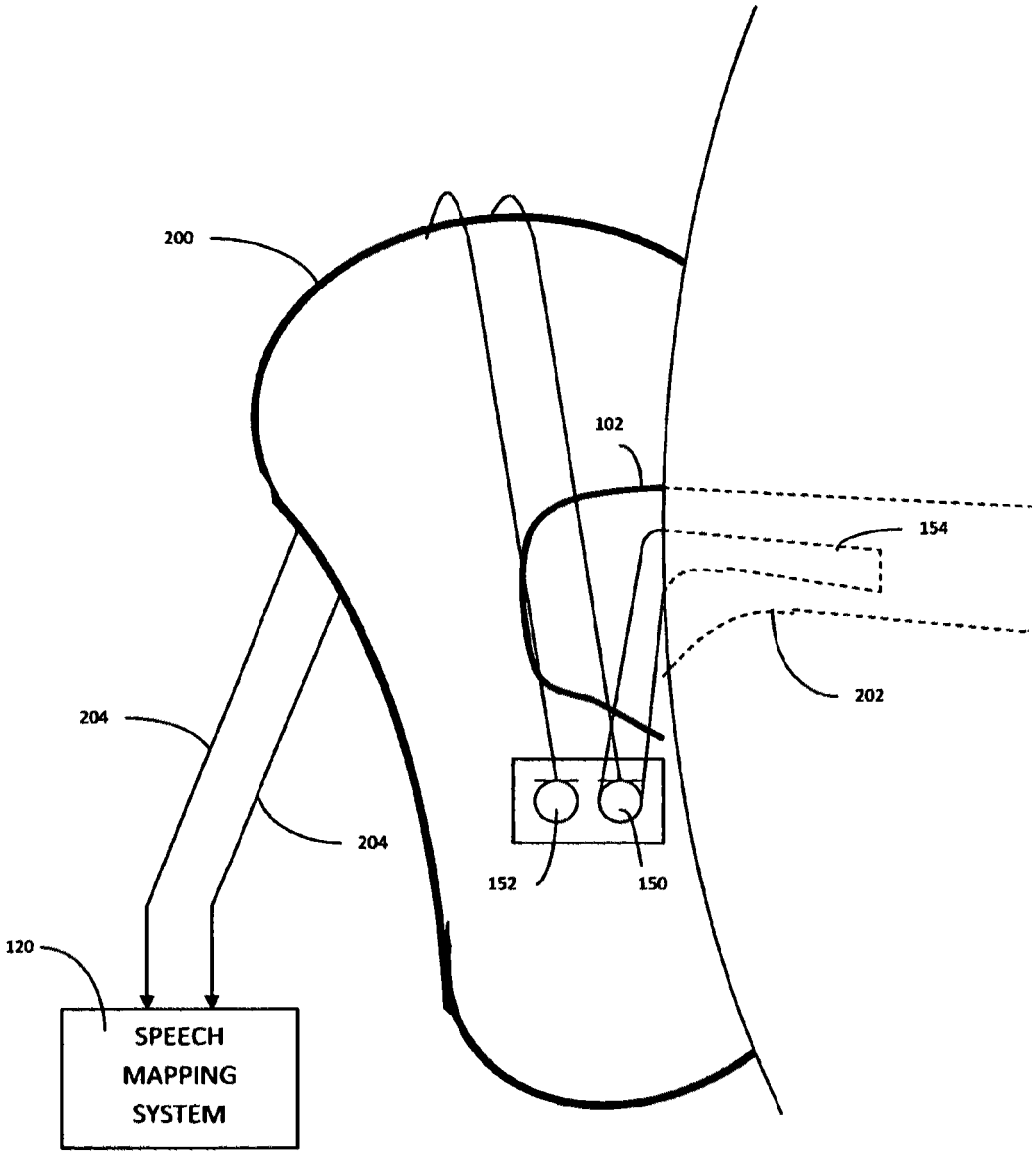
FIG. 2 is a diagram of a speech mapping system coupled with an ear.

As shown, for example, in FIG. 2, in one embodiment of the disclosed system, the microphones 150 and 152 are located on the outside of the user's ear 200. For example, they may be suspended in front of the ear via the cables 204. For example, the probe and reference microphones used in the MedRx Avant™ REM Speech System, available from MedRx, Inc. of Largo, Fla. may be utilized within the scope of the disclosure to implement the microphones 150, 152. The probe microphone 150 measures the sound pressure level ("SPL") in the ear after sound has been amplified by the hearing instrument 102. To accomplish this, the probe microphone 150 is connected to a tube 154 that is inserted into the ear canal 202 of the user's ear 200. The reference microphone 152 measures the SPL before the sound is amplified by the hearing instrument 102. While a probe microphone 150 connected to a tube having an opening within the ear canal is shown and described as the sensor for measuring the sound pressure level in the ear of the user, it is within the scope of the disclosure for other sensors, such as an in ear microphone or other sound or pressure sensor or even a microphone component of the hearing instrument itself to be utilized as the sensor for detecting the sound pressure level. Additionally, some other measurement indicative of how well the output of the hearing device is adjusted for the specific user may be utilized within the scope of the disclosure to measure the in ear response of the hearing instrument 102. While a reference microphone 152 is described as the sensor for measuring the sound pressure level outside the ear of the user, it is within the scope of the disclosure for other sensors, such as another sound or pressure sensor or even a microphone component of the hearing instrument itself to be utilized as the sensor for detecting the sound pressure level. Additionally, some other measurement indicative of the volume of a reference sound input may be utilized within the scope of the disclosure to detect the external stimulus levels.

The speech mapping system 120, along with the microphones 150, 152, obtains the gain of the hearing instrument 102 over time. This time domain signal is converted into a frequency domain signal using a fast Fourier transform ("FFT") to obtain the gain as a function of frequency. The gain is determined as the difference between the SPL inside the ear (as measured by the probe microphone 150) and the SPL outside the ear (as measured by the reference microphone 152). From this information, the speech mapping system such as the Med RX Advant™ REM Speech System can determine the gain that the hearing instrument should provide (the "target gain"). The speech mapping system 120 may include a memory, processor and a user interface (not shown). It is within the scope of the disclosure for the Fourier transform and or the gain calculation to be carried out by other illustrated components or additional components of the system, such as, for example, by processors and memory of the hearing instrument, or by the processor 302 and memory 304 of the parameter control system 130.

Figure 3:
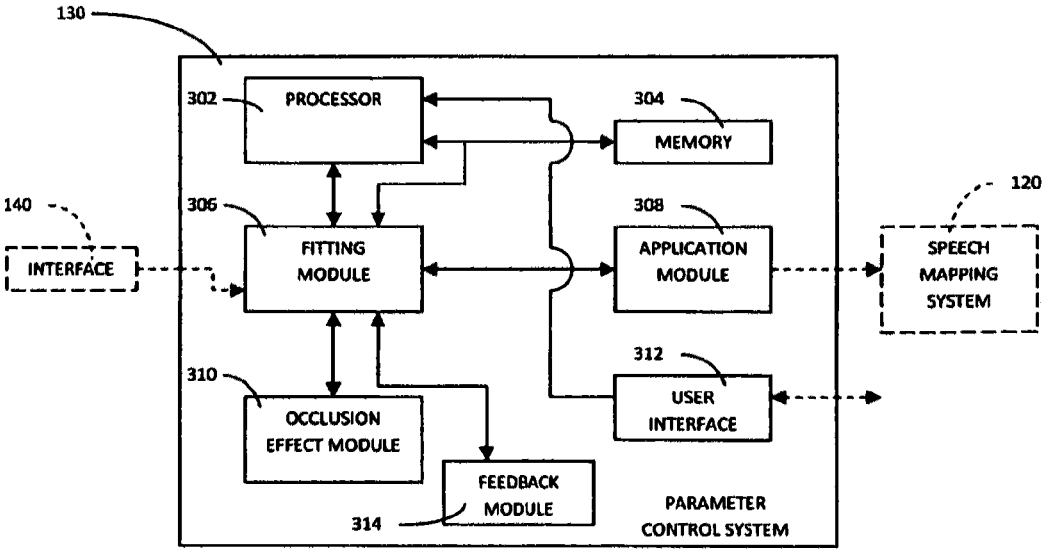
FIG. 3 is functional block diagram of a parameter control system.

As shown in FIG. 3, the parameter control system 130 generally includes a processor 302, a memory 304, a fitting module 306, an application module 308 and a user interface 312. The application module 308 and the fitting module 306 determine the required gain adjustment. Based on information received from the speech mapping system 120, the application module 308 and the fitting module 306 determine the required gain adjustment and communicate the adjustment to the hearing instrument 102. In addition, the parameter control system 130 may include an occlusion effect module 310 and/or a feedback module 314. These modules can adjust the gain to reduce the effects of occlusion and/or feedback, respectively. The gain adjustment is communicated to the hearing instrument 102 through an interface 140, such as a HIPRO Box made by G.N. Otometrics.

Figure 4:
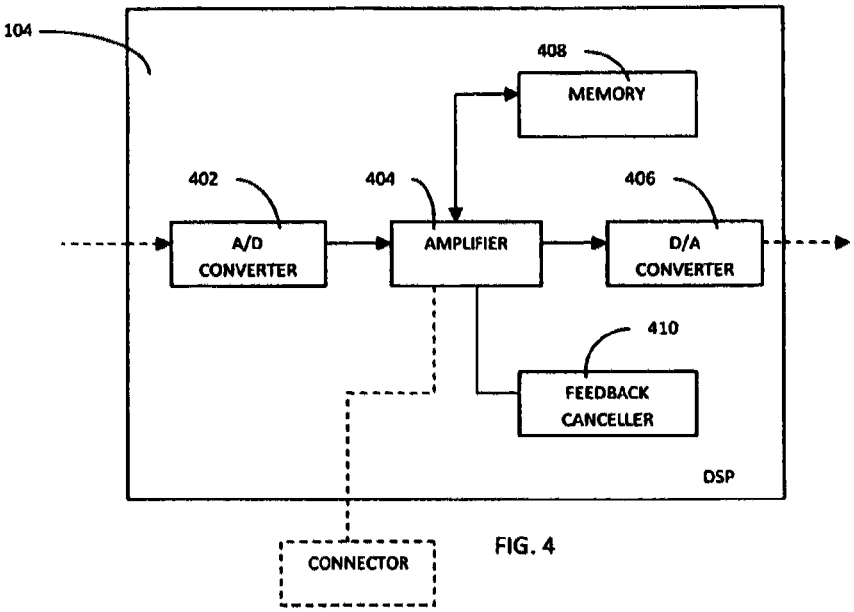
FIG. 4 is a functional block diagram of a digital signal processor (DSP) for a hearing instrument.

The hearing instrument 102 basically includes microphone 110, a digital signal processor ("DSP") 104, a receiver 108, a user interface 106 and a connector 114, as shown, for example, in FIG. 1. In addition, the hearing instrument 102 may include a feedback canceller 410, as shown, for example, in FIG. 4. When the hearing instrument 102 is in use, the microphone 110 receives sound signals present at the user's ear, which are then manipulated by the DSP 104 and outputted to the user by a receiver 108. As shown, for example, in FIG. 4, the DSP 104 generally includes an analog-to-digital ("A/D") converter 402, an amplifier 404, a digital-to-analog ("D/A") converter and a memory 408. The A/D converter 402 converts the sound signal into a digital signal, the amplifier 404 manipulates the sound in terms of gain and the D/A converter 406 converts the digital signal back into a sound signal that can be heard by the user via the receiver 108. The memory 408 may store protocols or routines for adjusting the parameters, such as gain, of the hearing device 102. These routines may be saved in the memory of the hearing instrument 408 incorporated by the manufacturer of the hearing instrument 102. The DSP 104 may also include modules that make other adjustments to the digital signal, such as modules to reduce noise and improve signal-to-noise ratios.

The user interface 106 may include a volume control (not shown) and a memory for storing preset parameters, such as gain and volume, which are designed for use in different listening environments. For example, if the user works in a factory with loud background noise, well-known noise reduction algorithms can be employed which are selectively engaged and disengaged by the user after the hearing instrument has been fitted according to one embodiment of the disclosed system 100.

The hearing instrument 102, speech mapping system 120, parameter control system 130 and the interface 140 may be implemented in a combination of hardware and computer-executable software. The processors may include any type of device or devices used to process digital information. Each of these components may include or be in communication with one or more processors and/or computer-readable memories. The memories may include any type of fixed or removable digital storage device and, if needed, a device for reading the digital storage device, including floppy disks and floppy drives, CD-ROM disks and drives, optical disks and drives, hard-drives, RAM, ROM and any other device or devices for storing digital information. The software may include object code, source code, or any computer-readable code, and may be stored in the one or more processors, and/or memory devices in any combination.

The user interface 312 of the parameter control system 130 and the user interface of the speech mapping system 120 (together the "user interface systems") may include any appropriate type of user interface for any type of computer, electronic device or terminal capable of digital communication. The user interfaces may include an input device and an output device (not shown). The output device may include any type of visual, manual, audio, electronic or electromagnetic device capable of communicating information from a processor or memory device to a person or other processor or memory device. Examples of output devices include, but are not limited to, monitors, speakers, headphones, liquid crystal displays, networks, buses, and interfaces. The input device may include any type of visual, manual, mechanical, audio, and/or electromagnetic device capable of communicating information from a person or memory to a processor or memory. Examples of input devices include keyboards, microphones, voice recognition systems, trackballs, mice, networks, buses, and interfaces. The input and output devices may be included in a single device such as a touch screen, computer, processor or memory device.

Figure 5A:
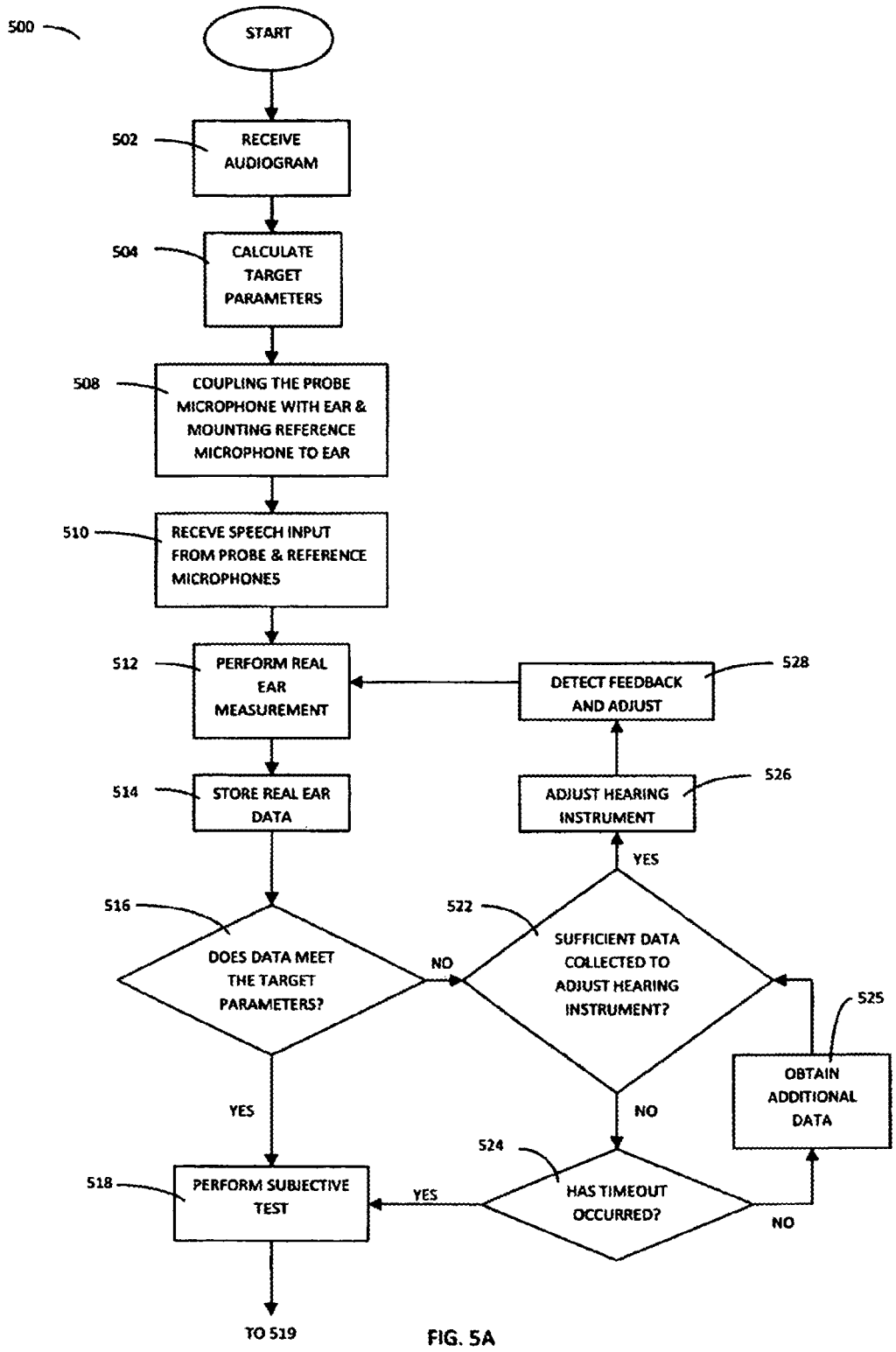
FIG. 5 is a flow chart of a method for adjusting hearing instrument parameters.
Figure 5B:
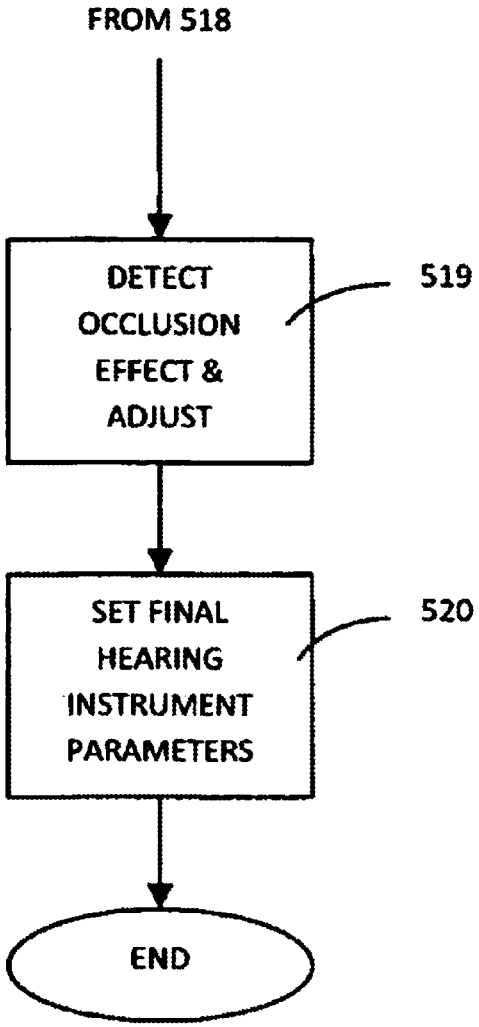

One embodiment of a method 500 for adjusting the parameters of a hearing instrument is shown in FIG. 5. Embodiments of the disclosed adjustment method 500 may include making real ear measurements of the in-ear sound pressure level with speech as the input and automatically adjusting the hearing instrument parameters, such as gain, based on the real ear measurement. The description that follows will make reference to FIGS. 1, 3 and 4, in addition to FIG. 5 in describing the illustrated embodiment of adjustment method 500.

Initially, the application module 308 of the parameter control system 130 receives a pre-measured audiogram via the fitting module 306 or other source such as an automated audiometer. The audiogram is then communicated with the speech mapping system 120. Then, in step 504, the speech mapping system 120 calculates the target parameters from the audiogram using a technique such as, Speech Banana, NAL-NL1 and DSL I/O. This calculation is made over a range of frequencies for one or more sound pressure levels. In one embodiment of the system and method, the target parameters are calculated for frequencies from about 20 Hz to about 20,000 Hz. In one embodiment of the system and method, the target parameters are calculated for frequencies from about 125 Hz to about 8,000 Hz, the typical range of human speech. In one embodiment the target parameters are calculated for a sound pressure level of normal speech, such as about 65 dB SPL. Target parameters for other sound pressure levels may be extrapolated from these calculated target parameter values utilizing standardized formulas, such as, for example, formulas provided by NAL-NL1 standards. In one embodiment of the disclosed system and method, the target parameters are calculated for three different power levels, such as 50, 65 and 80 dB SPL producing three sets of target data, one for each power level.

The speech mapping system 120 communicates the target data to the application module 308 of the parameter control system 130. Target data provided by well known standards is often provided only for certain frequencies, for example, target data is sometimes provided only for octave values (e.g. 125 Hz, 250 Hz, 500 Hz) at low frequencies and at half octave values (e.g. 2000 Hz, 3000 Hz, 4000 Hz 6000 Hz, 8000 Hz) at higher frequencies). Because the resolution of the target data may not be the same as that for the gain measurements, the application module 308 interpolates the target data to fit the resolution of the measured gain.

To begin the gain measurements, the hearing instrument 102 is coupled with the ear 200 of the user and the probe and reference microphones 150, 152, respectively, are placed near the outside of the ear 200 in step 508. In addition, the probe microphone 150 is coupled with the inside of the ear canal 202 via a tube inserted into the canal. In step 510 a speech signal is produced by a person speaking to or in the vicinity of the user and/or by playing a recording of speech in the vicinity of the user. The reference microphone 152 detects the SPL of the speech signal before the speech signal is manipulated by the hearing instrument 102 and the probe microphone measures the SPL of the speech signal within the ear 200 ("in-ear SPL") after the speech signal has been manipulated by the hearing instrument 102. The microphones communicate the measured SPLs to the speech mapping system 120.

In step 512, the speech mapping system 120 performs a real ear measurement and communicates the measurements with the application module 308 of the parameter control interface 130. In one embodiment of the disclosed system and method, the real ear measurements are continuously communicated. The speech mapping system 120 measures the in-ear SPL, over time, so that the application module 308 may capture the SPL of various types of speech. For example, speech varies in terms of pitch and volume. Therefore, in one embodiment of the disclosed system and method, the reference microphone 152 is exposed to the speech signal over time so that the application module 308 may capture the in-ear SPL, which reflects a variety of frequencies and power levels. For example, the application module 308 may look to capture different sound pressure levels that correspond to loud, conversational and soft speech signals. A sound level of about 50 dB SPL±about 3 dB may be used to represent soft speech, a sound level of about 65 dB SPL±about 3 dB may be used to represent a conversational level of speech and a sound level of about 80 dB SPL±about 3 dB may be used to represent loud speech.

In step 514, the parameter control module 130 stores the captured in-ear SPL in memory 304. For example, memory 304 may include a register into which the in-ear SPL is stored. In addition, the application module 308 may calculate an offset value as the difference between the target gain and the in-ear SPL and store the offset values in an offset register in memory 304. Because the in-ear SPL is measured over time, multiple values for a given frequency and power level may be obtained. In this case, in one embodiment of the disclosed system and method, the parameter control module 130 averages the in-ear SPL corresponding to the multiple values and stores the average in memory 304. Other statistical and data management methods may be utilized within the scope of the disclosure for storing multiple sensed SPL values for a particular frequency as a single representative SPL value for the particular frequency, such as the peak SPL, a normalized value, a median value, a peak value, etc. This helps to reduce the number of outliers to increase the amount of valid data points.

In step 516, the application module 308 determines if the in-ear SPL meets the target gain for the hearing instrument 102. In one embodiment of the disclosed system and method, to determine if the in-ear SPL meets the target gain for the hearing aid, the application module 308 compares the in-ear SPL with the target values and determines whether the in-ear SPL is sufficiently close to the target values. For example, the comparison can be made using two or more cycles, and if a ±2 dB SPL change in levels or less is seen, or if no further improvements in the target gain are possible without generating feedback or other adverse side effects can be made, the gain values for the last cycle maybe accepted. It is within the scope of the disclosure for the acceptable variation of the sensed gain from the target gain to be increased after several cycles, for example, to ±3 dB after four cycles and to ±5 dB after six cycles. Other methods of varying gain or other hearing aid responses may also be employed, such as changes in threshold knee points and/or compression ratios at certain frequencies or inputs, or other adjustments to hearing aid outputs. If the in-ear SPL meets the target gain, the gain is verified and adjusted as necessary according to a subjective test administered to the user.

If the measured in-ear SPL does not meet the target gain, the fitting module 306 of the parameter control system 130 determines whether there is sufficient valid SPL data with which to adjust the gain of the hearing instrument 102 in step 522. In one embodiment of the disclosed method, if there is insufficient data to adjust the gain of the hearing instrument 102, the parameter control module 130 waits to see if enough of the missing data is captured to allow an adjustment of the gain.

If, in step 524, a predetermined amount of time has passed or a predetermined number of measurements have been made, a "timeout" is said to have occurred and the application module 308 stops storing data. In at least one embodiment of the disclosed system and method, a "timeout" is not implemented. In embodiments of the disclosed system and method implementing "timeouts", the utilization of "timeouts" may speed up the test or to solve a "lack of data" problem. In one embodiment of the disclosed system and method, a "timeout" may also, or alternatively, be implemented by the speech mapping system 120 which collects data and sends it to the parameter control system. In other words, any data collecting could use statistics to "fill gaps" or "timeout" to apply a stop point and fill in data. At this point, the parameter control module 130 may use the data that has been captured to adjust the hearing instrument in step 526.

Alternately, the parameter control module 130 may attempt to capture additional in-ear SPL data points. In other embodiments, the missing data may be extrapolated from the neighboring frequency data points, a subsequent forced presentation of speech can be done with alternative loud or soft voices, or an automated fitting with pre-recorded stimuli that could be automatically generated by the parameter control system 130 based on the types of frequencies or bands that were missing data from the measuring process. The parameter control system 130 may prompt the user or fitter to read from a word list that would be likely to obtain the missing data. For instance, if for some high frequency bands not enough data is captured, the parameter control system 130 may prompt the user or other individual to say a phrase such as, "She Sells Sea Shells on the Sea Shore."

If, in step 522, the fitting module 306 determines that there is sufficient data to adjust the hearing instrument 102, the fitting module 306 adjusts the gain of the hearing instrument 102, via the interface 140, by the offset amount. Thereafter, the process begins again at step 512 and repeats until the data meets the target gain in step 516.

Once the target gain is met, the gain is verified and adjusted as necessary according to subjective test(s) administered to the user. For example, the dispenser can conduct a word recognition test well known in the industry and measure the accuracy of the user's response. The dispenser or a person of interest can engage in normal conversation or read to the user from selected word lists or text.

Figure 6:
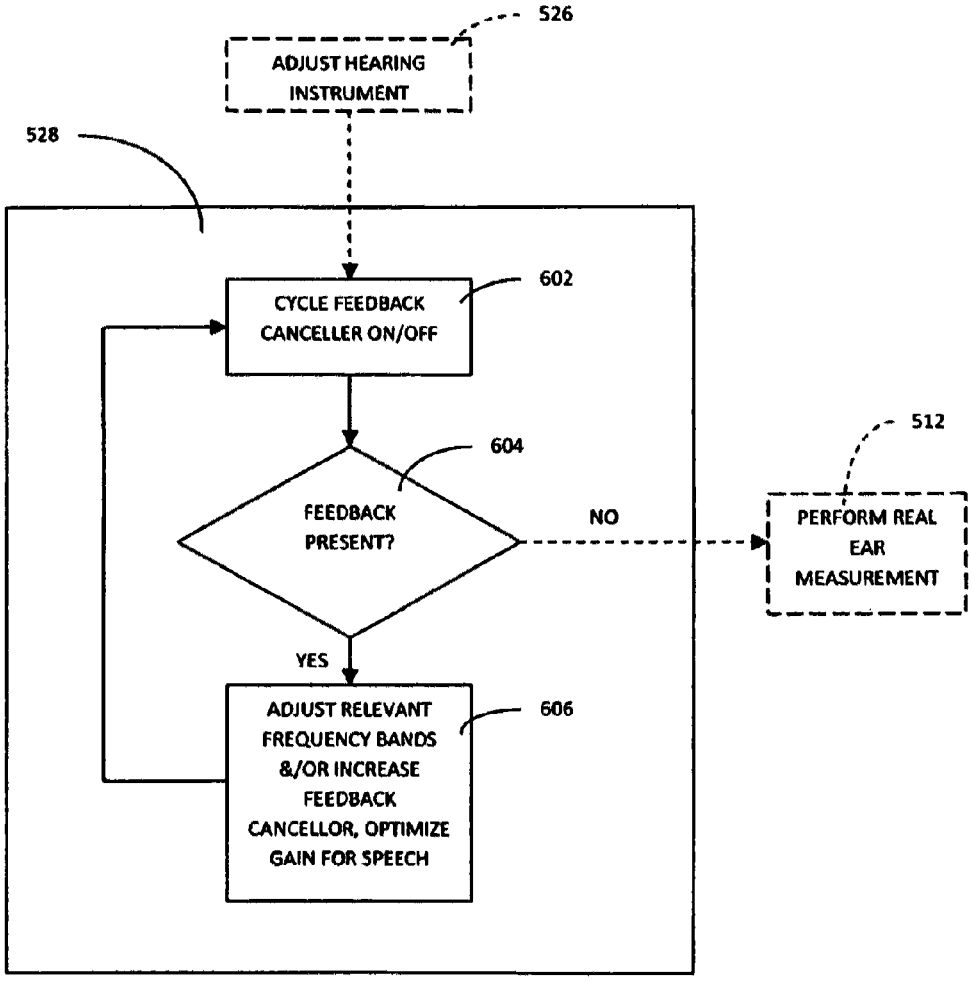
FIG. 6 is a flow chart of a method for measuring and adjusting for feedback.

Optionally, it is expected that the System 100 may detect feedback and adjust the gain and/or phase cancellation to minimize any detected feedback in step 528, one embodiment of which is shown in more detail in FIG. 6. To determine whether there is feedback present, the feedback canceller 410 of the hearing instrument may be cycled on and off in step 602. The speech spectrum is measured as a function of frequency when the feedback canceller 410 is on and when it is off. These two spectrums are subtracted one from the other and the peaks of the resulting difference are analyzed to determine the frequencies at which feedback, if any, occurs. For example, peaks of the resulting difference, which are greater than 6 dB, may be used to identify the frequencies at which feedback occurs. If feedback is detected in step 604, the appropriate adjustments are made to the gain at the frequencies at which the feedback occurs and/or the feedback canceller is increased in step 606. In this manner, feedback is reduced while preserving gain as much as possible. After the adjustments are made in step 606, the process repeats from step 602 until it is determined that the feedback can no longer be detected, at which point the entire process repeats from step 512.

Figure 11:
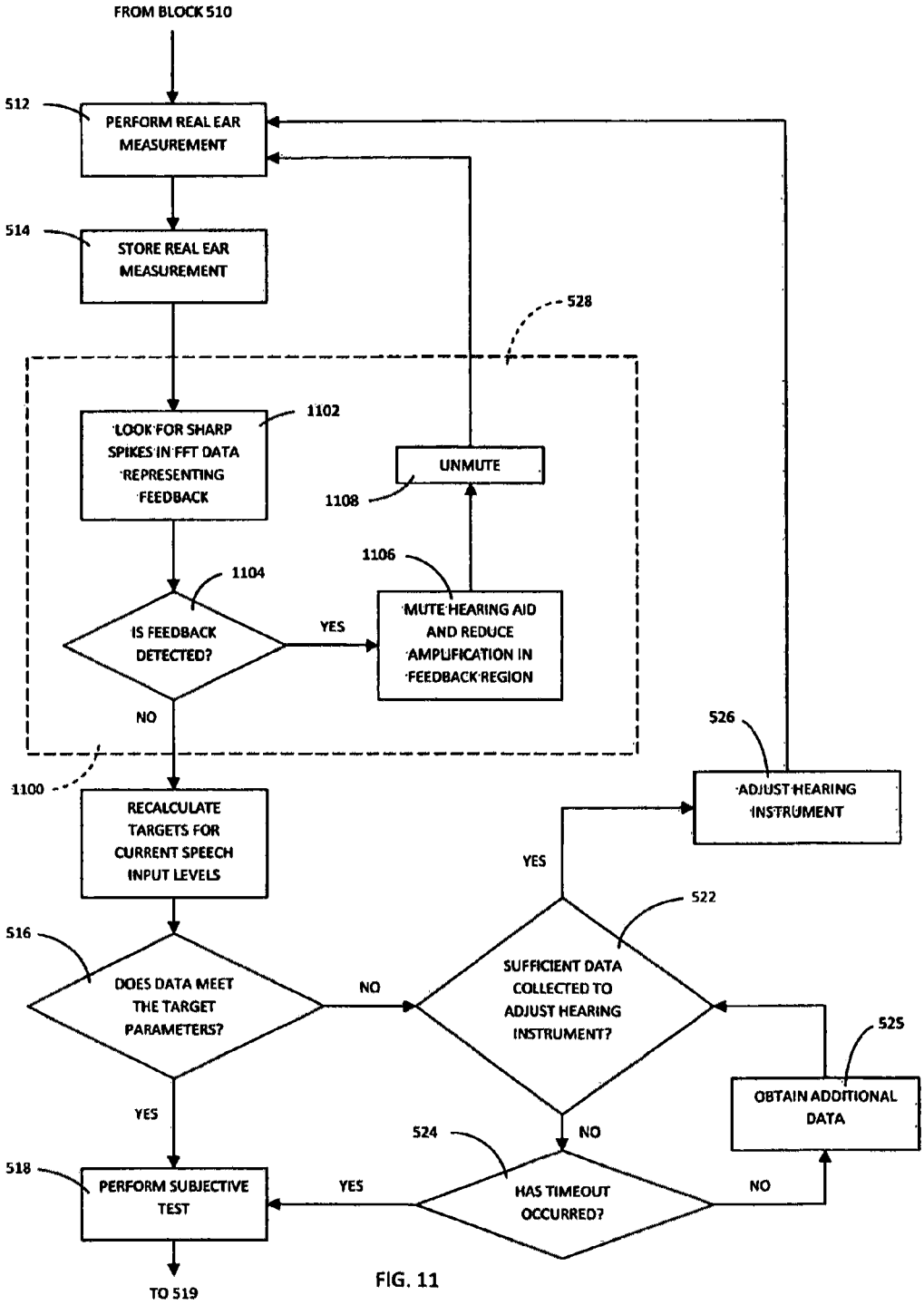
FIG. 11 is a flow diagram of a portion of the of adjusting hearing instrument parameters utilizing a method of detecting and reducing feedback wherein the feedback control in the hearing instrument is not disabled.

In another embodiment 1100 of the step 528 of minimizing feedback, as shown, for example, in FIG. 11, the speech mapping module is configured to detect spikes, or other indicators of feedback, in the in-ear SPL data in steps 1102 and 1104. In step 1102, the real ear measurements are examined to determine if sharp spikes occur in the fast fourier transformation data. As part of the automation routine, the speech mapping from the in-ear or canal resonance data may be deemed to indicate feedback if the peak SPL is higher than the long term average in a given frequency region in step 1104.

In one embodiment, upon detecting an indication of feedback from examination of the in-ear SPL data, the output of the hearing device is immediately muted in step 1106 to minimize discomfort to the user. In one embodiment, the exterior SPL data is examined to determine if a false feedback indication has been detected, such as when an external sound source shows unusual SPLs in the frequency of the detected feedback, for example, someone in the room where the fitting is being conducted may have whistled or some device may have generated a loud noise. If an external input is determined to have generated the indicator of feedback, the disclosed system and method may make no adjustments to the gain or feedback cancellation levels of the hearing device.

If the feedback indication is deemed to be true feedback, in one embodiment of the disclosed system and method, the gain of the hearing device in the frequency range at which an indication of feedback has been detected is reduced in step 1106. In one embodiment the gain in the appropriate band(s) is reduced by 12 dB. It is within the scope of the disclosure to reduce the gain in the appropriate bandwidth by other amounts in an effort to reduce or eliminate feedback. Following the gain reduction in the frequency band(s) where feedback was indicated the hearing device is turned on again in step 1108 and the process is repeated continuing to reduce gain in the band in which feedback is detected until feedback is no longer detected. If at any time, it is determined that the indication of feedback was the result of false feedback, the gain is restored to prior levels in the frequency in which feedback had been detected. Those skilled in the art will recognize that if the hearing device includes a feedback phase cancellation module, instead of decreasing gain when feedback is detected, the phase cancellation may be increased to eliminate feedback. Many devices, including external microphones 152 or other external devices may be utilized to detect false feedback within the scope of the disclosure.

One advantage of the immediately above described embodiment 1100 of the feedback reduction step 528 is that the feedback control in the hearing instrument is never disabled, facilitating the attainment of the maximum added stable gain that the given feedback canceling algorithm of the measured hearing instrument is capable of producing. It also increases patient comfort by quickly eliminating the feedback in the ear canal. If the offset gains in the feedback region indicate that the target gain cannot be attained without inducing feedback, the decision may be made to stop attempting to increase the gain beyond the level at which the onset of feedback is detected. Thus, the described feedback method facilitates maximizing the dynamic range of the patient while considering the maximum capabilities of the feedback canceller of the instrument at the same time.

Figure 7:
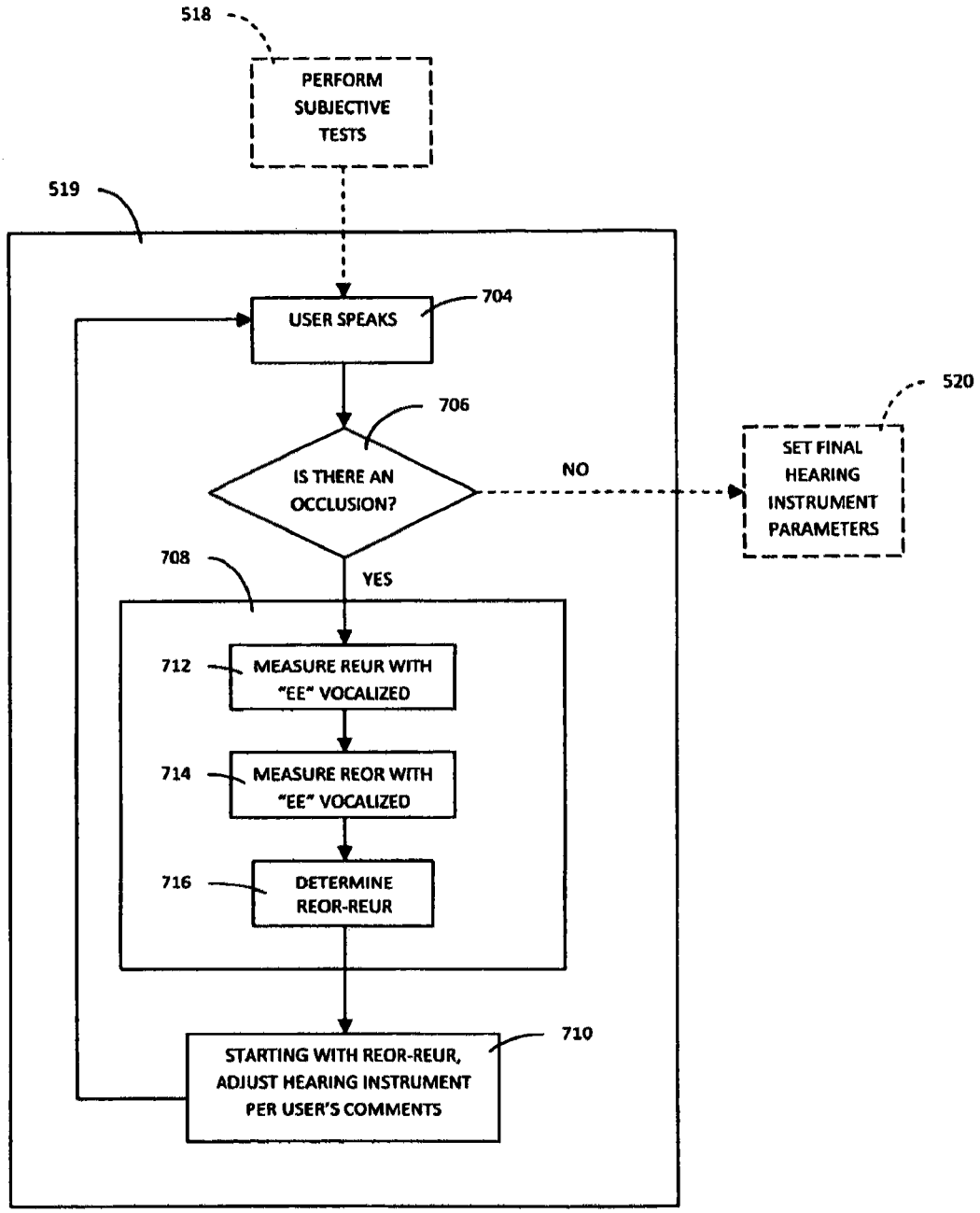
FIG. 7 is a flow chart of a method for measuring and adjusting for an occlusion effect.

In one embodiment of the disclosed system and method, the gain may be adjusted to minimize the occlusion effect in step 519, which is shown in more detail in FIG. 7. After, or as part of the subjective test performed in step 518, the user speaks in step 704 and based on how the user's voice sounds to him or her, determines whether there is an occlusion in step 706. If the user detects an occlusion, the occlusion is measured in step 708 and the hearing instrument is adjusted to reduce the occlusion in step 710.

It is expected that measuring the occlusion effect may include measuring the real ear unoccluded response ("REUR") as the user vocalizes the sound "EE" in step 712, measuring the real ear occluded response ("REOR") as the user vocalizes the sound "EE" in step 712 and determining the difference between REOR and REUR in step 716. The gain of the hearing instrument is adjusted in step 710, starting with REOR-REUR, according to the user's comments. The process then repeats from step 704 until the occlusion effect is reduced to an amount that is tolerable to the user. After this point is reached, the entire process continues at step 520.

As indicated above, the disclosed automatic hearing instrument fitting system permits live speech to be used to fit the hearing aid to the subjective needs of the patient, including the patient's own speech. In addition, the live voice of spouses, relatives or other persons of interest may also be used to fit the hearing aid to the important sources of communication to the patient in daily life. Use of speech as a parameter of the automatic fitting process will also permit the dispenser to employ languages other than his or her native language in the fitting process via pre-recorded audio types, disks or live speech of third parties. In addition, the dispenser can present, via pre-recordings or providing lists of words or sounds to be heard by persons at the fitting, a wide variety of sounds and frequencies, some of which may be used to obtain data points for soft sounds and high frequencies. It is also contemplated that other complex audio signals, such as music, or voice or music in combination with replicated noise inherent in the patient's expected work environment could be employed as the input signal and used to fit the digital hearing instrument according to the disclosure.

Thus, the disclosed automatic fitting systems use speech, including live speech, to achieve the desired fitting for the individual patient, taking into account the patient's subjective responses and physiological conditions to achieve a hearing instrument output that closely mirrors the desired input sounds and voices for that patient from the patient's environment and perspective. Use of the occlusion modules and/or feedback modules of the disclosed system and method further increases patient comfort and lessens undesired sounds during automatic fitting while the hearing aid is being worn by the patient and in subsequent use of the device by the patient outside the dispenser's offices. Applicants' expect that patients fitted according to the disclosure will make fewer return trips to the dispenser, and patients will be able to be fitted more quickly, more comfortably and/or with better precision than with prior systems.

By way of an example, a speech based automated hearing aid fitting system according to one embodiment of the present disclosure may be used to fit digital programmable hearing aids 102, such as in the ear (ITE), behind the ear (BTE), over the ear (OTE), open fitting or pocket hearing aids, such as a Monet 4D BTE or Evok 727 hearing aid made by Magnatone Hearing Aid Corporation, Casselberry, Fla. In one embodiment of the disclosed system, the interface device 140, such as a HIPRO Box, can be connected to the hearing aid 102 and the parameter control system 130, which may include software running on a desktop or laptop computer, such as a HP Pavillion 2D 8000 series laptop using Windows XP as its operating system. The parameter control system 130 may also be connected to the speech mapping system 120, such as a MedRx Avant REM speech system, to show live speech mapping. In one embodiment of the disclosed system, VoicePro software program (Magnatone Hearing Aid Corporation) can be used on the parameter control system 130 to adjust the speech map displayed on the computer screen to the desired gain for the patient wearing the hearing aid 102 and listening to the speech input. The patient is also wearing the reference microphone 152 attached to the hearing aid interface. In one embodiment of the disclosed system, a cable 204 connects the external reference microphone 152 located around ear lobe height and a probe microphone 150 coupled to a hearing probe 154 inserted into the patient's ear canal interconnected to the control system. In one embodiment of the disclosed system, the microphones 150, 152, probe 154 and cables 204 may be implemented using the MedRx Advant REM Speech system mentioned above. When the patient is presented with speech input sounds, the reference microphone 152 detects the input SPL and the probe microphone 150 detects the output SPL of the hearing aid 102 and transfers those signals via their cables 204 to the control system.

Figure 8:
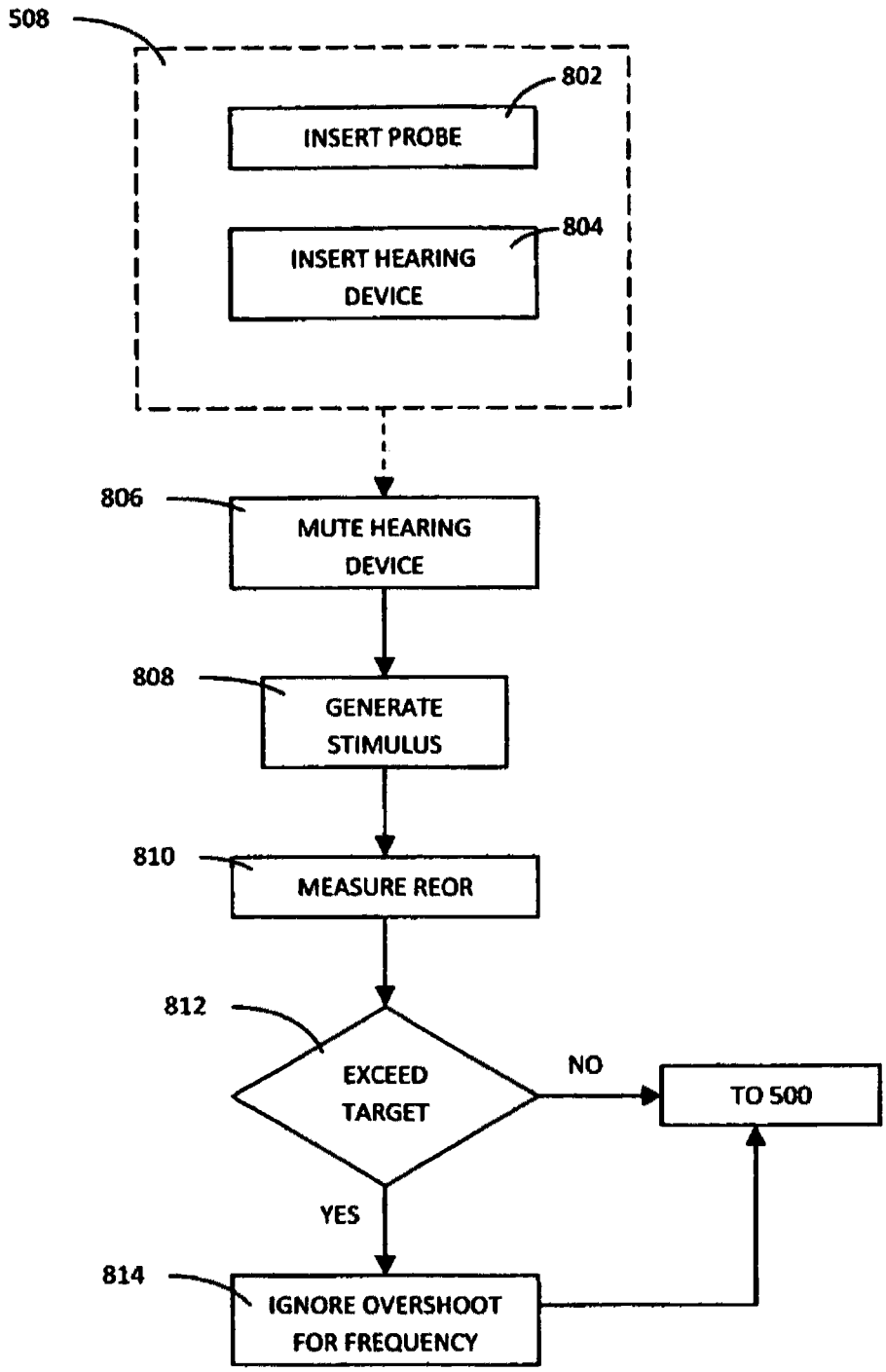
FIG. 8 is a flow chart of a calibration routine for determining a real ear occluded response of a hearing device to identify frequencies that do not need to be amplified by the hearing device.

In one embodiment of the disclosed method, a calibration step 800, as shown for example, in FIG. 8, helps to determine which frequencies are getting "to the ear drum" or at least to the probe microphone 150 which are not a result of amplification from the hearing instrument 102. In one embodiment of this calibration step 800, the probe tube 154 coupled to the probe microphone 150 is inserted in the ear canal in step 802 and the hearing aid 102 is positioned in its use position in step 804. The hearing device is muted in step 806 and the desired stimuli is generated in step 808. The response in the ear canal to the non-amplified stimuli (REOR—real ear occluded response) are measured in step 810. In step 812 it is determined whether the measured response shows that the "pass through" energy is greater than the proposed target response (NAL-NL1 for instance) for the frequencies to be tested and for which the gain can be adjusted for the hearing aid 102. If the pass through energy does not exceed the target response, the steps of method 500 may be completed. If the pass through energy is greater at some frequencies than the target response, then there is no way to subtract energy from the canal to reach target at those frequencies.

For example, especially with open fittings, or if a very large vent is needed, low frequency enters the ear canal naturally and passes through to the ear drum. Since low frequencies are often not amplified for hearing losses which are considered normal in the low frequencies, the SPL data from the probe microphone may exceed the target gain at some frequencies. Thus, the disclosed system and method may be configured to "ignore" apparent overshoots of the target gain in step 814 with regard to those frequencies at which the REOR—real ear occluded response indicates that the "pass through" energy is greater than the proposed target response. By ignoring these overshoots the system and method may avoid an endless loop when offsets are not reducing and achieving the target curve might be impossible.

Figure 9:
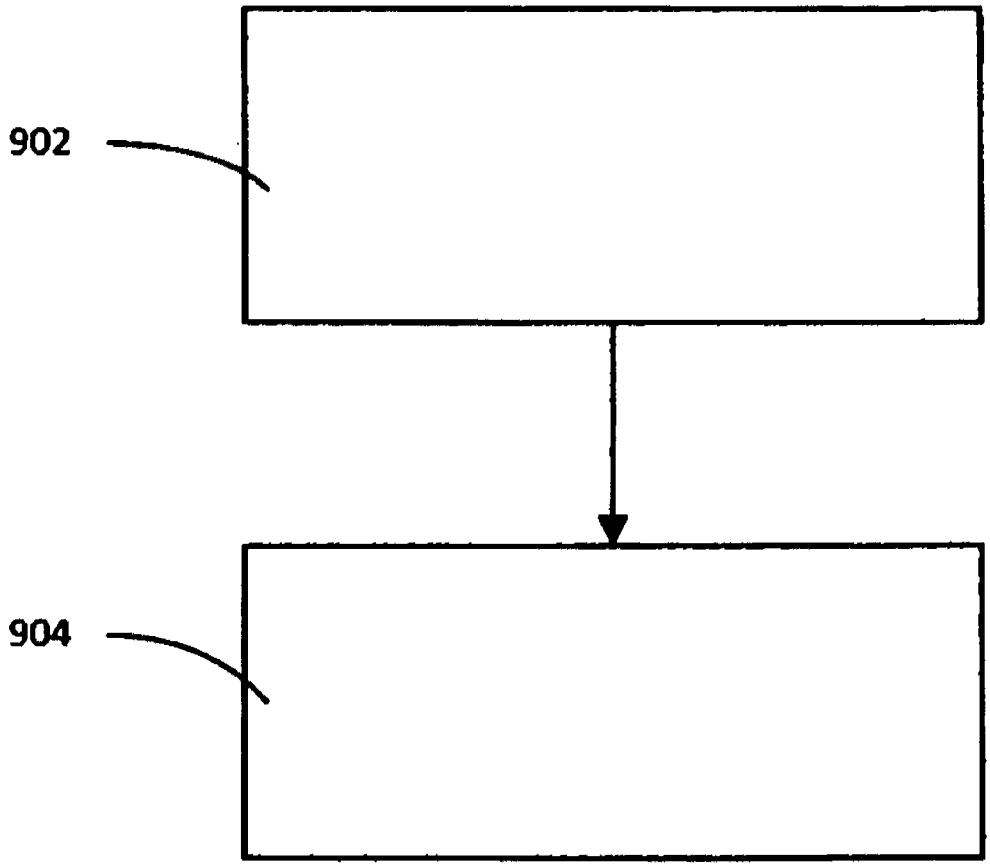
FIG. 9 is a flow chart of a routine that employs a floating stimulus adjustment to accommodate input stimuli with varying volumes.
Figure 10:
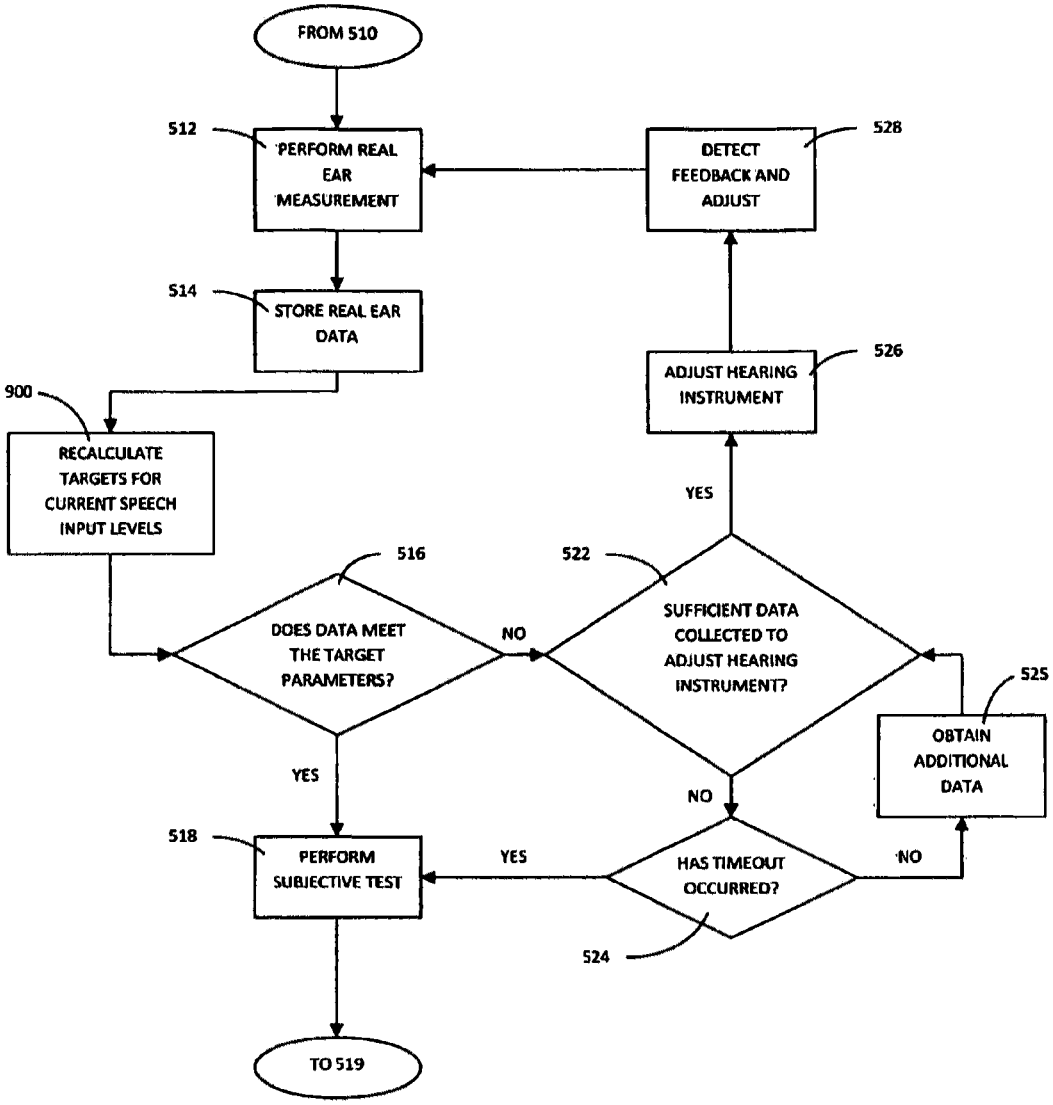
FIG. 10 is a flow diagram of a portion of the method of adjusting hearing instrument parameters shown in FIG. 5 with the floating stimulus adjustment routine of FIG. 9 incorporated therein.

Those skilled in the art will recognize that live speech can not be presented at a fixed SPL. The human voice is too dynamic to present long term average speech at a consistent level. In order to ensure that tests are repeatable, one embodiment of the disclosed method and system employs a floating stimulus adjustment 900, as shown, for example, in FIGS. 9 and 10. As shown, for example, in FIG. 10, in one embodiment of the disclosed method 500, the floating stimulus adjustment 900 is performed after the real ear data is stored in step 514 and before it is determined whether the data meets the target parameter in step 516. In step 902, the input SPL is analyzed through the reference microphone 152. The target gains are recalculated for the measured input SPL in step 904. This ensures that the offset gain for all frequencies have the same reference point. Such approach increases the likelihood that the target gains will be repeatable when different stimuli, such as different speakers' voices, are utilized to fit the hearing device.

Data regarding the adjustments to, and/or final settings for, hearing devices from various manufacturers that have been fitted utilizing the disclosed automated real speech hearing instrument adjustment system and method may be stored in memory and linked to the manufacturer and model of the hearing device and/or to the audiogram for the user for whom the hearing device was fitted. Over time a large amount of data regarding the settings for and adjustments to each model of hearing device that has been fitted utilizing the disclosed automated real speech hearing instrument adjustment system and method may be developed. This archived data may be numerically or statistically manipulated to establish initial baseline settings for each model of hearing device that has been adjusted utilizing the automated real speech hearing instrument adjustment system and method. Such archived data may also be utilized to establish initial base line settings for each model of hearing aid by comparing audiograms for a user to be fitted with a hearing device to stored audiograms of users previously fitted with the same device. Utilization of these initial baseline settings may further reduce the time required to properly fit a user with a hearing device.

While the disclosed system and method have been described as utilizing a single standard (illustratively, the NAL-NL1 standard) for determining a target formula, the automated nature of the disclosed system and method naturally lends itself to utilizing several different target formulas. Thus it is within the scope of the disclosure for an initial adjustment to be made to a hearing device utilizing a first target formula and further adjustments to be made utilizing a different target formula. In one embodiment, after an initial adjustment or fitting of a hearing device for a user using a first target formula and a word test or some other validation, a score for the adjustment is recorded. The hearing device is then re-fit to the same user utilizing a different target prescription utilizing the same validation as used in the initial adjustment. A score applying the same criteria as utilized to develop the score for the first adjustment is then recorded for the re-fit. The scores for the initial adjustment and the re-fit are compared and the hearing device is fitted utilizing the target formula which generated the better score. The re-fit target formula may in one embodiment consider different factors, such as age of the patient, years previously wearing a hearing instrument, cochlear damage, central issues of the brain, etc., than the first target formula. It is within the scope of the disclosure for a series of tests to be performed.

In another embodiment, after the initial fitting of the hearing instrument is complete, the dispenser can perform a further automated feedback silencing process to detect and reduce feedback caused by dynamic events that occur during exposure to a stimulus while the hearing instrument is placed in a wearer's ear. The stimulus can be live speech or random speech. Live speech can be a person speaking by or in the vicinity of a user or can simply be ambient noise. Random speech can be any other type of speech, as defined previously. In addition to live speech and random speech, one can also use prerecorded speech as the stimulus, which commonly consists of prerecorded syllables that result in unintelligible speech. Dynamic events include physical events that induce feedback in the hearing instrument, such as, for example, a hearing instrument user being given a hug, using a telephone or a cellular phone, turning his or her head, opening his or her jaw, being in an automobile, or having a person's hand waived in close proximity to the wearer's ear. In contrast, conventional fitting systems and methods do not perform, in situ, a feedback silencing process for dynamic events.

Figure 12:
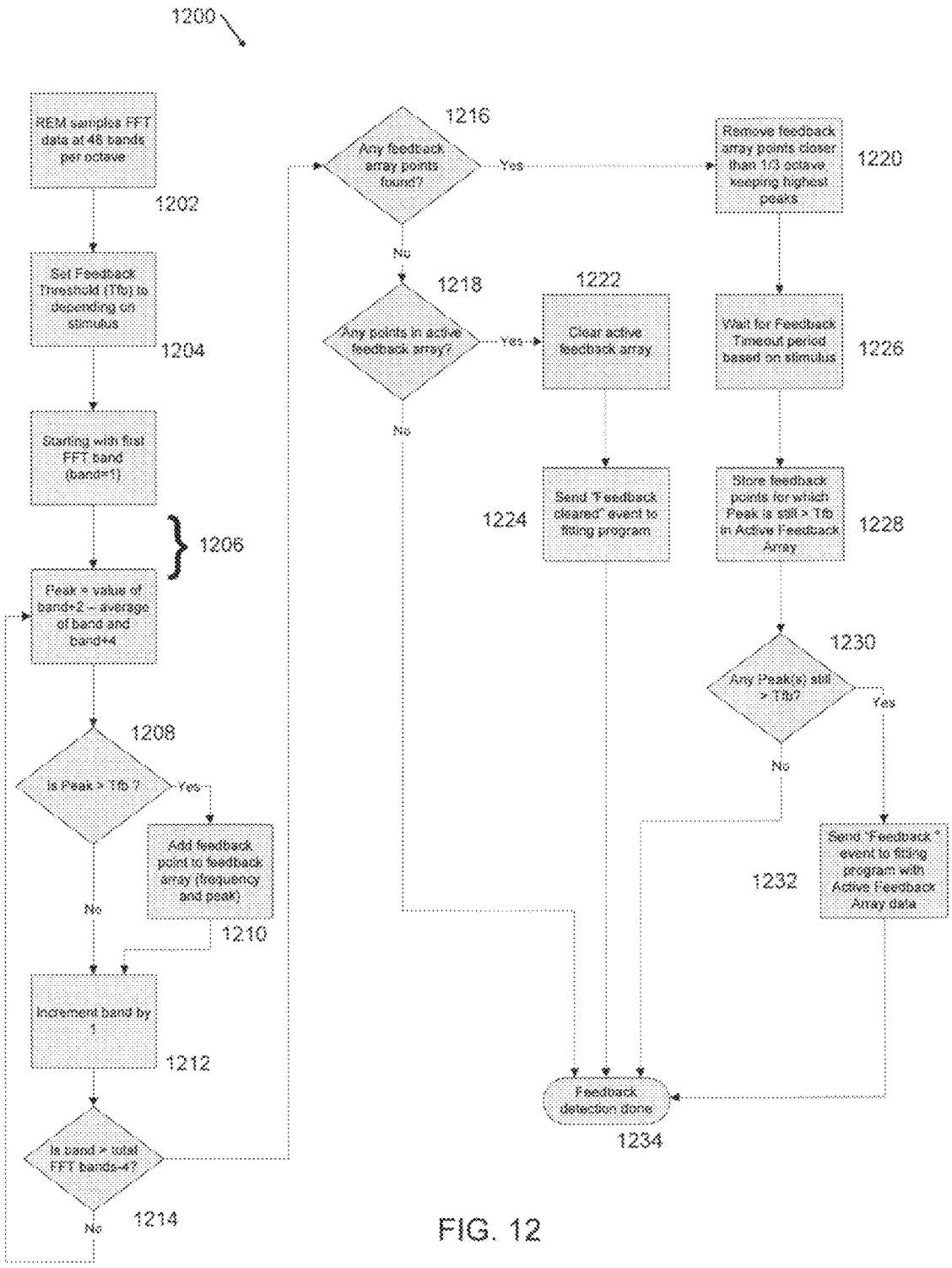
FIG. 12 is a flow chart of a method for detecting feedback.

In a preferred embodiment, feedback detection is carried out by the speech mapping system 120, having a memory, a first processor, a second processor and a user interface. FIG. 12 shows a flowchart of an embodiment of feedback detection 1200. A predetermined feedback threshold gain ("Tfb") is set in decibels ("dB") when starting feedback detection 1204, and is typically dependent on the type of stimulus used. In a preferred embodiment, the value for the predetermined feedback threshold gain is empirically determined by selecting a value and decreasing that value until false feedback is detected. The presence of false feedback is based on detection of false feedback when no feedback is actually heard from the hearing instrument. In a particularly preferred embodiment, the predetermined feedback threshold gain used for most stimuli is 17 dB, although for some stimuli the feedback threshold may be set at a higher level. Various predetermined feedback threshold gain levels may be pre-programmed into the speech mapping system for selection by the dispenser depending on the stimulus being used.

Once the predetermined feedback threshold gain has been set, a real ear measurement is performed using a probe microphone and a reference microphone to measure the SPL inside the ear and the SPL outside the ear while the wearer is exposed to a stimulus and a dynamic event. The speech mapping system uses a first processor to determine the gain of the hearing instrument as the difference in sound pressure level measured by the probe microphone and the reference microphone in decibels, over time in a time domain signal. The time domain signal is converted into a frequency domain signal using an FFT to obtain the gain in decibels as a function of frequency, measured in hertz ("Hz"). FFT is performed in segments of 48 frequency bands per octave. The number of segments used are generally determined by the equipment being used by the dispenser. The resulting data is referred to as FFT data. The speech mapping system's first processor samples or analyzes the FFT data in segments of 48 frequency bands ("FFT bands") per octave 1202.

In a preferred embodiment, the speech mapping system uses a first processor to identify a frequency in the center of a range of frequencies in the FFT data ("FFT band") and analyze the FFT data corresponding to the FFT band for any spikes or peaks 1206 measured in amount of gain as a function of frequency. In a particularly preferred embodiment, the range of frequencies is a window of frequency bands. The window of bands selected typically contains an odd number of bands, so that one band is always in the center of the window. In a preferred embodiment, the window of bands consists of a group of five, seven or nine bands. In a particularly preferred embodiment, the window consists of five bands. It has unexpectedly been found that the smaller window reduces the detection of false feedback. The frequency band in the center of a window is compared to the other peaks in the window and to the predetermined feedback threshold gain. In general, a spike or peak exists when the frequency band in the center of a window has the maximum gain in the window. In a preferred embodiment, a spike or peak exists when its gain is also above the predetermined feedback threshold gain.

For example, in a five band window if every band is assigned a number, band number three is the center band. Spikes or peaks in a range of frequencies are identified as corresponding to the maximum gain in that range of frequencies. Spikes or peaks in a window of bands are identified as having the maximum gain of the frequency bands in that window. In a preferred embodiment, spikes or peaks in a window of bands are identified as having a gain greater than the average of the gain of the FFT bands above the center of the window and the gain of the FFT bands below the center of the window 1206. For example in a 5 band window, spikes or peaks in a window of bands are identified as having a gain greater than the average of the gain of FFT band 1 and FFT band 2 and the gain of FFT band 4 and FFT band 5. Any detected spikes or peaks are identified as potential feedback peaks and their gain and frequency are added to a feedback array 1210 that stores the gain and frequency of any potential feedback peaks in a memory in the speech mapping system. In a preferred embodiment, any potential feedback peaks are compared to the predetermined feedback threshold gain 1208. If a potential feedback peak's gain is greater than the predetermined feedback threshold gain, the potential feedback peak's gain and its frequency are added to the feedback array 1210.

After any potential feedback peaks are added to the feedback array or if no potential feedback peaks are found, feedback detection continues as the speech mapping system's first processor moves on to the next FFT band by incrementing the value of the current FFT band by one 1212. The speech mapping system's first processor determines whether the newly incremented FFT band is the last FFT band to be analyzed by comparing the value of the incremented FFT band to the total number of FFT bands minus the total number of bands in the window being used subtracted by 1, e.g. the total number of FFT bands minus four when using a 5 band window 1214. If the incremented FFT band is not greater than this value, then feedback detection starts again for the new FFT band. If the incremented FFT band is greater than this value, it is the last FFT band to be analyzed and feedback detection continues to the next step.

The feedback array is analyzed by the speech mapping system's first processor to determine whether the gain and frequency of any potential feedback peaks are stored 1216 in the array. If potential feedback peaks are stored in the feedback array, any potential feedback peaks located closer than one third of an octave to each other ("false feedback peaks") are removed to prevent inclusion of false feedback and the highest potential feedback peaks ("feedback peaks") are kept 1220. In a preferred embodiment, after removal of the false feedback peaks, a period of time is allowed to elapse ("feedback timeout period") 1226 after the initial exposure to the stimulus and dynamic event to determine the reduction or decay of the gain of any feedback peaks and to identify the persisting potential feedback peaks ("active feedback peaks"). The user should still be experiencing feedback during and immediately after the period of elapsed time. As a result, the length of the period of elapsed time used will depend on the stimulus being used. Values for the period of elapsed time may be determined using a trial and error approach to ensure feedback is still occurring during and immediately after the timeout period, but has reduced sufficiently to ensure only the desired feedback peaks remain. In a preferred embodiment, the period of time allowed to elapse is between about 170 to about 1000 milliseconds.

After the period of time has elapsed, the speech mapping system uses the first processor to measure the gain of the hearing instrument and obtain the corresponding FFT data. This FFT data is compared to the initial FFT data obtained during the onset of the dynamic event. In a preferred embodiment, only the active feedback peaks that continue to persist and have a gain above the predetermined feedback threshold gain after the period of time has elapsed are retained and stored in a memory in a separate active feedback array that contains the gain and frequency of the remaining feedback peaks 1228.

If the active feedback array contains data corresponding to feedback peaks having a gain above the feedback threshold after the feedback timeout period 1230, a feedback event containing the active feedback array data is sent to a second processor in the speech mapping system 1232. Once the second processor receives the feedback event, feedback detection is complete 1234.

If no feedback peaks remain that have a gain above the feedback threshold after the feedback timeout period 1230, then feedback detection is complete 1234 and no further steps are required.

If no potential feedback peaks are present in the feedback array 1216, the active feedback array is analyzed by the first processor to determine whether any feedback peaks are still present 1218 from a previous feedback detection. If feedback peaks from a previous feedback detection are present in the active feedback array, the data in the active feedback array is cleared 1222 to reflect that no potential feedback peaks were found in the current feedback detection. A feedback cleared event is sent to the second processor 1224, after which the feedback detection process is complete 1234. If no feedback peaks remain in the active feedback array from a previous feedback detection, then the feedback detection process is complete 1234.

Figure 13:
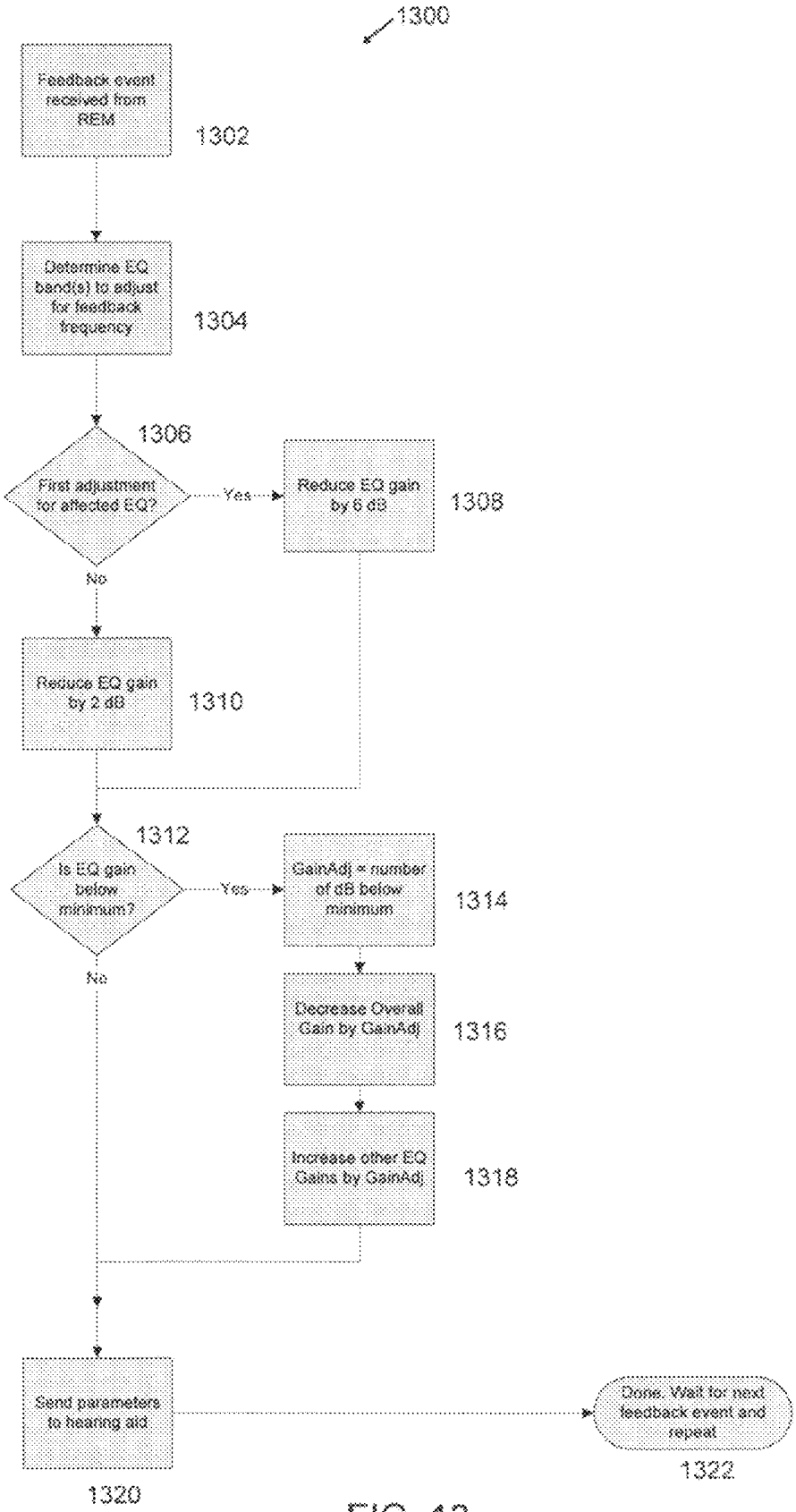
FIG. 13 is a flow chart of a method for adjusting for feedback.

As shown in FIG. 13, feedback silencing 1300 begins once the second processor receives a feedback event 1302 from the first processor and memory of the speech mapping system. The feedback silencing process is an optional feature that can be part of or built into the speech mapping system. The dispenser turns on the feedback silencing process by using the speech mapping system interface, such as by clicking on an icon on a computer screen, prior to exposing the hearing instrument wearer to a stimulus and dynamic event and beginning feedback detection. The second processor analyzes the feedback event data and determines the adjustments that need to be made to the hearing instrument to reduce the gain at a frequency corresponding to the frequency of the feedback peak. In a preferred embodiment, the second processor analyzes the feedback event data and determines which of the hearing instrument's equalizer bands ("EQ band") to adjust depending on the frequency of the feedback peak 1304. The hearing instrument's adjustable EQ bands constitute an adjustable frequency response, since the EQ bands are adjustable in response to receiving certain frequency data. Hearing instruments generally are pre-programmed with a certain number of equalizer bands on the hearing instrument's circuitry. Each EQ band corresponds to a predetermined range of frequencies, which is typically determined by the hardware used in the hearing instrument. In a preferred embodiment, the hearing instrument has 12 EQ bands, which are assigned numbers 1 through 12. The frequency of the feedback peak is compared to the frequencies of the hearing instrument's EQ bands to determine which band the feedback peak's frequency falls within. The EQ band containing the frequency corresponding to the feedback peak's frequency is the band that will require adjustment. If the frequency corresponding to the feedback peak's frequency falls between EQ bands, both the EQ band above and the EQ band below the feedback peak's frequency typically will require adjustment.

In a preferred embodiment, the EQ bands correspond to the frequency ranges: EQ1 for a range of 0 to 299 Hz; EQ2 for a range of 300 to 649 Hz; EQ2 and EQ3 for a range of 650 to 749 Hz; EQ3 for a range of 750 to 1249 Hz; EQ3 and EQ4 for a range of 1250 to 1349 Hz; EQ4 for a range of 1350 to 1649 Hz; EQ4 and EQ5 for a range of 1650 to 1749 Hz; EQ5 for a range of 1750 to 2189 Hz; EQ5 and EQ6 for a range of 2190 to 2299 Hz; EQ6 for a range of 2300 to 2649 Hz; EQ6 and EQ7 for a range of 2650 to 2749 Hz; EQ7 for a range of 2750 to 3149 Hz; EQ7 and EQ8 for a range of 3150 to 3249 Hz; EQ8 for a range of 3250 to 3749 Hz; EQ8 and EQ9 for a range of 3750 to 4749 Hz; EQ9 for a range of 3850 to 4649 Hz; EQ9 and EQ10 for a range of 4650 to 4749 Hz; EQ10 for a range of 4750 to 5649 Hz; EQ10 and EQ11 for a range of 5650 to 5749 Hz; EQ11 for a range of 5750 to 6649 Hz; EQ11 and EQ12 for a range of 6650 to 6749 Hz; and EQ12 for a range of 6750 Hz and higher.

Once the EQ band or bands requiring adjustment ("affected equalizer band(s)") are identified, their gain ("EQ gain") is adjusted, resulting in an adjusted frequency response of the hearing instrument. If it is the first time an affected equalizer band is adjusted 1306, the affected equalizer band's gain is reduced by 6 decibels ("dB") 1308. If the affected equalizer band has previously been adjusted by the speech mapping system, the affected equalizer band's gain is reduced by 2 dB 1310.

Each EQ band covers a specific range of decibels in a finite number of steps. Each EQ band has a minimum gain to ensure that every EQ band has sufficient gain to be audible to the wearer. Most EQ bands have the same range, generally 40 dB in 20 steps, which the gain cannot be reduced below. Once the gain of the affected equalizer band has been reduced, the second processor determines whether the affected equalizer band's new gain is below the minimum gain 1312. If the affected equalizer band's new gain is below the minimum gain, the second processor determines the number of decibels the equalizer band is below the minimum gain 1314 to determine the gain adjustment ("GainAdj"). The overall gain of the hearing instrument is reduced by the gain adjustment 1316. Next, the gain of the unaffected equalizer bands is increased by the gain adjustment 1318. This increase in gain of all of the unaffected bands effectively reduces the gain in the affected equalizer band without reducing the affected equalizer's gain below the minimum level. Once the affected equalizer band's gain is no longer below the minimum level, the frequency response adjustments are sent to the hearing instrument 1320. The feedback silencing process is complete until feedback is detected again and the resulting feedback event 1322 is sent to the speech mapping system's second processor to determine the appropriate adjustment of the hearing instrument's frequency response.

If the gain of the affected equalizer band is not below the minimum level 1312 after being adjusted, the frequency response adjustments are sent to the hearing instrument 1320 and the feedback silencer process is complete until feedback is detected again 1322. As long as the feedback silencer is turned on, feedback detection will continue until the dispenser determines that the feedback process is complete.

The dispenser will determine, based primarily on comments received by the user or wearer regarding the presence of feedback and also on his or her training and experience, when the feedback caused by the dynamic event has been reduced to an acceptable level. In an embodiment, the dispenser first exposes the wearer's ear to a stimulus without a dynamic event, determines any feedback peaks and adjusts the hearing instrument as described above. The dispenser then exposes the wearer's ear to a second stimulus and dynamic event and determines the gain as a function of frequency from the difference in sound pressure level measured by the probe microphone and the reference microphone in response to the second stimulus and dynamic event. A second feedback peak is identified in response to the second stimulus and dynamic event, as previously described. The hearing instrument is adjusted to reduce gain at a frequency corresponding to the frequency of the second feedback peak.

After the dispenser and wearer are satisfied that the feedback has been reduced to an acceptable level, the dispenser will turn off the feedback silencing process by pressing a button or clicking a button on a screen on a user interface. The parameters corresponding to the frequency response adjustments are saved in a memory in the hearing instrument. If the hearing instrument has multiple memories, the dispenser may choose to store the saved parameters in a specific memory in the hearing instrument. Saving the frequency response adjustment parameters in a separate memory in the hearing instrument allows a user to change the setting of the hearing instrument during a dynamic event to minimize the amount of feedback experienced.

While various embodiments have been described, it will be apparent to those of ordinary skill in the art that many more embodiments and implementations are possible within the scope of the invention. Accordingly, the invention is not to be restricted except in light of the attached claims and their equivalents.

What is claimed is:

1. A method for adjusting a hearing instrument to reduce feedback, comprising:

placing a hearing instrument having an adjustable frequency response in a wearer's ear;

providing a probe microphone for measuring the sound pressure level inside the ear, and a reference microphone for measuring the sound pressure level outside the ear;

exposing the ear to a stimulus and a dynamic event;

determining a gain as a function of frequency from the difference in sound pressure level measured by the probe microphone and the reference microphone;

identifying a feedback peak where the frequency is in the center of a range of frequencies and corresponds to the maximum gain in that range of frequencies; and adjusting the hearing instrument to reduce the gain at a frequency corresponding to the frequency of the feedback peak.

2. The method of claim 1, wherein the dynamic event is a physical event.

3. The method of claim 1, further comprising the step of:

providing a predetermined feedback threshold gain; and wherein a feedback peak is identified where the frequency is in the center of a range of frequencies and corresponds to the maximum gain in that range of frequencies, and the gain is greater than the feedback threshold gain.

4. The method of claim 3, wherein the feedback threshold gain is 17 dB.

5. The method of claim 1, wherein the gain as a function of frequency is determined in segments of frequency bands, and a feedback peak is identified where the frequency band in a window of frequency bands has the maximum gain of the frequency bands in that window.

6. The method of claim 5, wherein the window of frequency bands has an odd number of frequency bands.

7. The method of claim 5, wherein the window of frequency bands has 5 frequency bands.

8. A method for adjusting a hearing instrument to reduce feedback, comprising:

placing a hearing instrument having an adjustable frequency response in a wearer's ear;

providing a probe microphone for measuring the sound pressure level inside the ear, and a reference microphone for measuring the sound pressure level outside the ear;

exposing the ear to a stimulus and a dynamic event;

determining a gain as a function of frequency from the difference in sound pressure level measured by the probe microphone and the reference microphone;

identifying a potential feedback peak where the frequency is in the center of a range of frequencies and corresponds to the maximum gain in that range of frequencies;

allowing a period of time to elapse and identifying an active feedback peak where the potential feedback peak persists after the period of time has elapsed; and adjusting the hearing instrument to reduce the gain at a frequency corresponding to the frequency of the active feedback peak.

9. The method of claim 8, wherein the dynamic event is a physical event.

10. The method of claim 8, wherein the period of time is in a range of between about 170 to about 1000 milliseconds.

11. The method of claim 8, further comprising the step of:

providing a predetermined feedback threshold gain; and wherein a potential feedback peak is identified where the frequency is in the center of a range of frequencies and corresponds to the maximum gain in that range of frequencies, and the gain is greater than the feedback threshold gain.

12. The method of claim 11, wherein the feedback threshold gain is 17 dB.

13. The method of claim 8, wherein the gain as a function of frequency is determined in segments of frequency bands, and a feedback peak is identified where the frequency band in a window of frequency bands has the maximum gain of the frequency bands in that window.

14. The method of claim 13, wherein the window of frequency bands has an odd number of frequency bands.

15. The method of claim 13, wherein the window of frequency bands has 5 frequency bands.

16. A method for adjusting a hearing instrument to reduce feedback, comprising:

placing a hearing instrument having an adjustable frequency response in a wearer's ear;

providing a probe microphone for measuring the sound pressure level inside the ear, and a reference microphone for measuring the sound pressure level outside the ear;

exposing the ear to a first stimulus;

determining a gain as a function of frequency from the difference in sound pressure level measured by the probe microphone and the reference microphone in response to the first stimulus;

identifying a first feedback peak in response to the first stimulus, where the frequency is in the center of a range of frequencies and corresponds to the maximum gain in that range of frequencies;

adjusting the hearing instrument to reduce the gain at a frequency corresponding to the frequency of the first feedback peak;

exposing the ear to a second stimulus and a dynamic event;

determining the gain as a function of frequency from the difference in sound pressure level measured by the probe microphone and the reference microphone in response to the second stimulus and dynamic event;

identifying a second feedback peak in response to the second stimulus and dynamic event, where the frequency is in the center of a range of frequencies and corresponds to the maximum gain in that range of frequencies; and adjusting the hearing instrument to reduce the gain at a frequency corresponding to the frequency of the second feedback peak.

17. The method of claim 16, wherein the dynamic event is a physical event.

18. The method of claim 16, further comprising the step of:

providing a predetermined feedback threshold gain: and wherein a potential feedback peak is identified where the frequency is in the center of a range of frequencies and corresponds to the maximum gain in that range of frequencies, and the gain is greater than the feedback threshold gain.

19. The method of claim 18, wherein the feedback threshold gain is 17 dB.

20. The method of claim 16, wherein the gain as a function of frequency is determined in segments of frequency bands, and a feedback peak is identified where the frequency band in a window of frequency bands has the maximum gain of the frequency bands in that window.

21. The method of claim 20, wherein the window of frequency bands has an odd number of frequency bands.

22. The method of claim 20, wherein the window of frequency bands has 5 frequency bands.

* * * * *